United States Patent [19]

Spychalski

[11] 4,134,344

[45] Jan. 16, 1979

[54] RAILWAY HOPPER CAR DOOR LOCK

[75] Inventor: Robert A. Spychalski, Michigan City, Ind.

[73] Assignee: Pullman Incorporated, Chicago, Ill.

[21] Appl. No.: 786,726

[22] Filed: Apr. 11, 1977

[51] Int. Cl.[2] ..... B61D 7/02; B61D 7/18; B61D 7/26; B61D 49/00

[52] U.S. Cl. ..... 105/248; 105/308 E; 105/308 P

[58] Field of Search ..... 105/248, 259, 308 B, 105/308 E, 308 R, 310, 308 P; 52/566; 292/24, 26

[56] References Cited

U.S. PATENT DOCUMENTS

| | | | |
|---|---|---|---|
| 640,403 | 1/1900 | McChesney | 292/26 |
| 1,644,599 | 10/1927 | McDearmon | 52/566 |
| 1,664,599 | 4/1928 | Dzierzenga | 292/26 X |
| 1,766,193 | 6/1930 | Schmitz et al. | 292/24 |
| 1,941,774 | 1/1934 | Yost | 105/308 R X |
| 2,943,693 | 7/1960 | Norrie | 292/26 X |
| 3,104,623 | 9/1963 | Dorey | 105/248 |

*Primary Examiner*—L. J. Paperner
*Assistant Examiner*—Howard Beltran
*Attorney, Agent, or Firm*—Thomas G. Anderson

[57] ABSTRACT

A railway hopper car having doors movable downwardly and outwardly to a dump position is provided with an improved locking arrangement that includes a cam lever actuated by means of a push-pull link extending outwardly under the side of the hopper. The link is pivotally connected to a camming lever having a hinged latch element connected thereto. The latch element and camming lever are locked in a relatively angular position. The link arrangement upon actuation moves the cam lever and link to a substantially linear configuration thereby disengaging the latching element from the keeper member provided on the door structure.

10 Claims, 6 Drawing Figures

FIG. 1
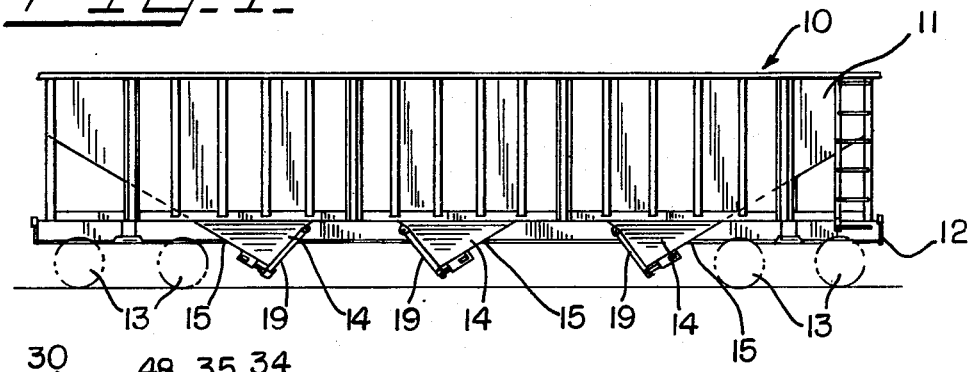
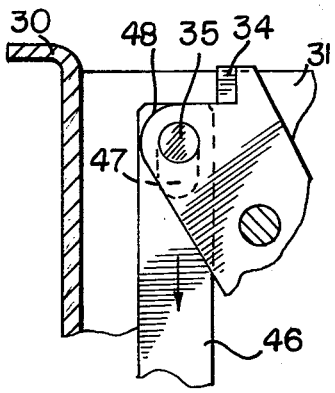
FIG. 4
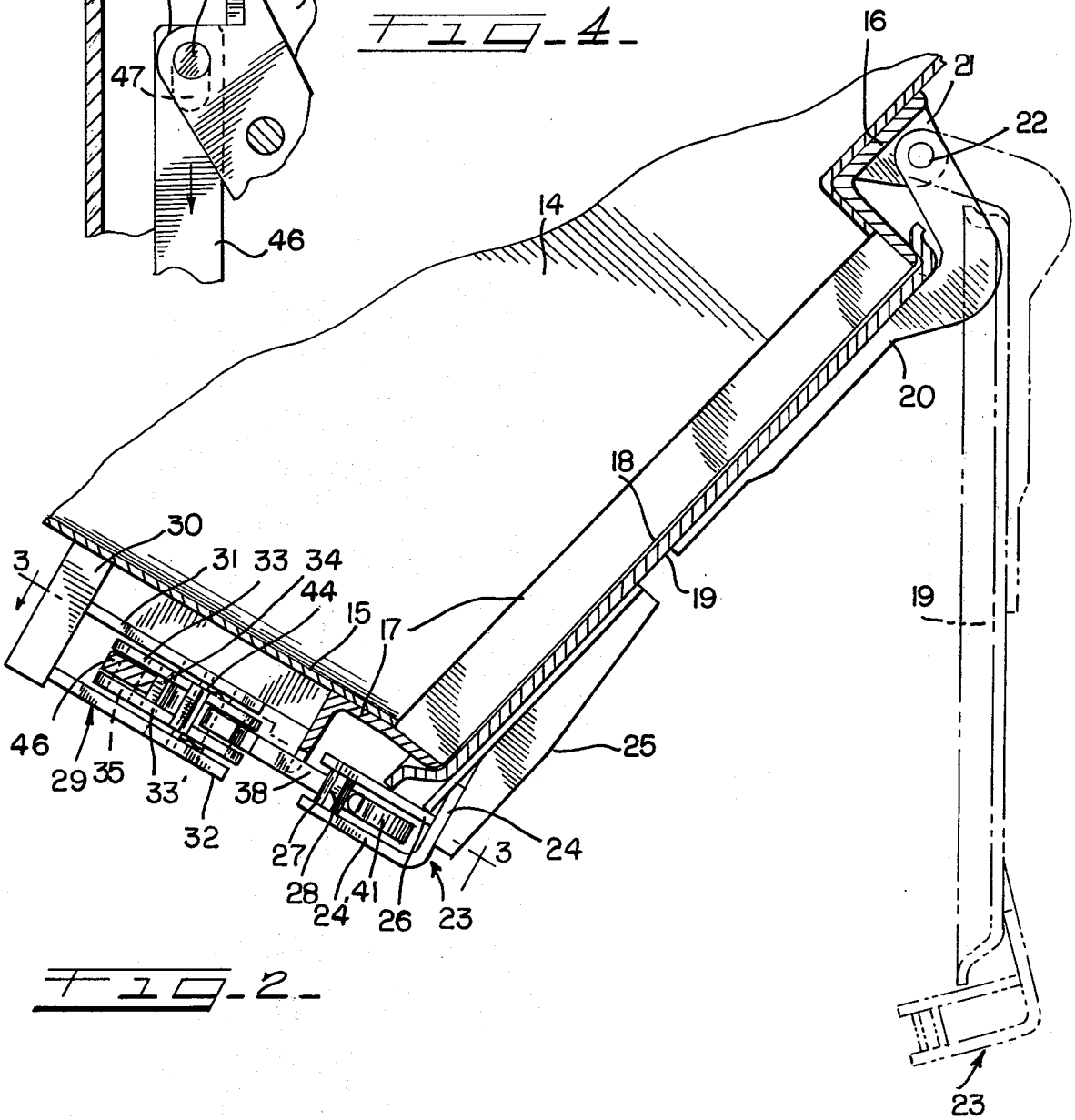
FIG. 2

RAILWAY HOPPER CAR DOOR LOCK

BACKGROUND OF THE INVENTION

1. Field of the Invention

The present invention relates to open top railway hopper cars having lower hinged doors which are actuated for release by an improved locking mechanism.

2. Description of the Prior Art

Patents disclosing the prior art are U.S. Pat. No. 640,403 Jan. 2, 1900 and U.S. Pat. No. 1,766,193 June 24, 1930 which show latches having pivoted latching elements; U.S. Pat. No. 2,943,693 July 5, 1960 which discloses a pivoted latching arrangement for a vehicle cab; and U.S. Pat. No. 3,104,623 Sept. 24, 1963 which shows a pivoted closure latching mechanism for a railway hopper car. The present locking mechanism for railway hopper car doors is an improvement over the aforementioned patents.

SUMMARY OF THE INVENTION

In the present invention a downwardly and outwardly swinging hinged door of a hopper is retained in a securely locked position during transit by means of a latch and cam lever arrangement. The cam lever is supported on the structure of the car and is pivotally movable with respect thereto on a bracket member. The cam lever has connected thereto at one end a latch lever having at its outer end a hook shaped projection providing a socket and an angular camming means adapted to engage and slide upon a keeper bar which is supported on the door structure. The latch lever is pivotally connected to the cam lever so as to assume an angled or relatively jack-knife position in the lock position of the mechanism. The cam lever is maintained in the angled position by means of a stop which is in engagement with a stop portion of a push-pull link, said link providing for rotating movement of the cam lever. Upon release movement of the link, the end of the link is placed out of engaging position relative to the cam stop of the cam lever and during this pulling movement the cam lever rotates in such a direction that the lever and link assumes a relatively linear position which upon continued pulling on the link provides for raising of the latch element from locking engagement with the keeper mounted on the door. As the cam lever is rotated a cam stop on the lever engages a cam stop on the latch element and a linear position of the two is achieved against the spring action of a spring which biases the lever to maintain the linear position when the cam lever and latch element are raised out of engagement with the keeper bar.

BRIEF DESCRIPTION OF THE PRIOR ART

FIG. 1 is a side elevational view of a railway hopper car having bottom discharge arrangements including an improved door locking arrangement;

FIG. 2 is a side cross-sectional view through a portion of a hopper car disclosing the improved locking or latching arrangement;

FIG. 4 is a detail cross-sectional view showing a position of a link relative to a cam lever;

DESCRIPTION OF THE PREFERRED EMBODIMENT

Figure 3:
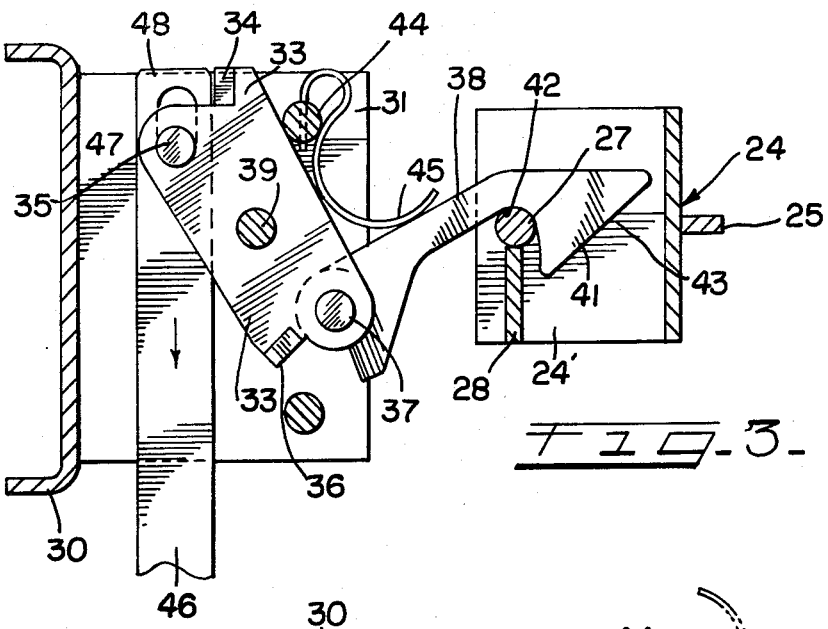
FIG. 3 is a cross-sectional view taken substantially along the line 3-3 of FIG. 2 showing a locking and latching arrangement in a locked position with respect to a hinged bottom discharge door.

A railway hopper car 10, as shown in FIG. 1 includes side walls 11, and underframe 12 suitably mounted on car trucks 13. The car 10 includes a plurality of hoppers 14 usually carrying comminuted bulk materials. Such hoppers conventional in the art include slope sheets 15 connected to transversely extending supporting structure 16 supported from the underframe 12 of the car 10. Each hopper includes a lower frame 17 defining a discharge opening 18 adapted to be closed by means of a door 19. Hinge brackets 20 on the door 19 are hingedly connected to hinge brackets 21 on the structure 16 by means of hinge pins 22.

Figure 5:
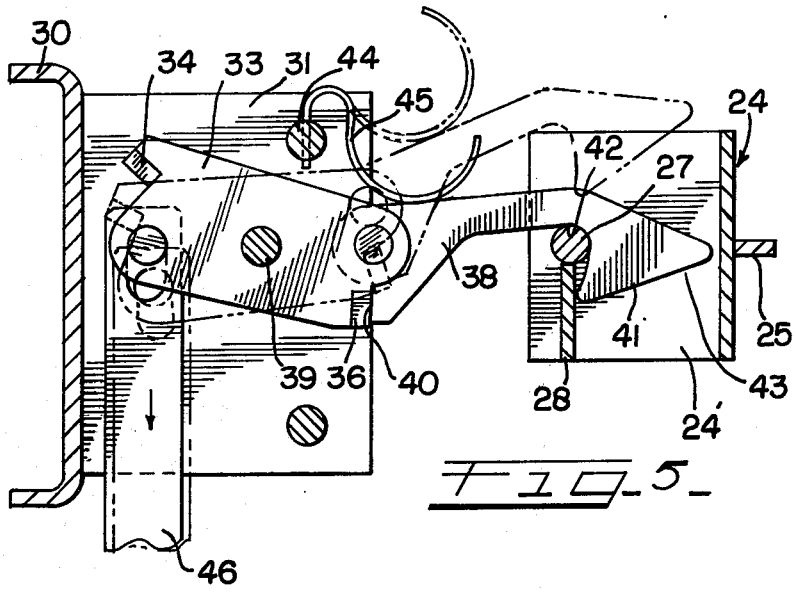
FIG. 5 is a view similar to FIG. 3 showing a cam lever and latching element substantially in linear position just prior to its release relative to a keeper arrangement.

A door keeper 23 includes an angle shaped bracket 24 having a flange 24' of a plate support 25 rigidly connected to the under side of the door 19. An inner plate 26 is parallel to the flange 24' on the brackets 24 and a keeper bar 27 is connected to the plate 26 and flange 24; a reinforcing plate 28 as best shown in FIG. 5 is also connected to the keeper bar 27.

A latch mechanism is generally designated at 29 and includes a bracket 30 rigidly connected to the under side of the slope sheet 15. An inner bracket plate 31 and an outer bracket plate 32 are connected to the bracket 30 as best shown in FIG. 2. A cam lever 33 including a pair of spaced cam plates 33' are positioned between the plates 31 and 32. The cam lever 33 includes cam stop 34 and are pivoted on the plates 31 and 32. One lower end of the cam lever 33 includes a cam stop 36, and a pivot pin 37 which is pivotally connected to a latch arm and element 38. A pivot shaft 39 connects the cam lever 33 to the plates 31 and 32.

The latch element 38 also includes a stop member 40 adapted to engage the stop 36 during a linear position of the cam lever 33 relative to said latch element 38. The latch element has a hook shaped head 41 including a keeper engaging socket 42 and an outer tapering surface 43.

A spring support 44 is connected on plates 31 and 32 and support a curved leaf spring 45 adapted to engage and bias the cam lever 33. A push-pull link 46 includes a slot 47 at one end which also contains a stop surface adapted to engage the stop 34.

THE OPERATION

In the positions shown in FIGS. 2 and 3 the door of the particular hopper involved is in a securely locked position with the keeper element or rod 27 securely in engagement within the socket 42 of the latch lever 38. The cam lever 33 is securely held against rotation in one direction by means of the cam stop 34 being in engagement with the stop end 48 of the lever 46. The spring leaf 45 at this point also forces the latch arm 38 downwardly into the secure locking engagement relative to the keeper 27. Thus the door is securely locked.

Figure 6:
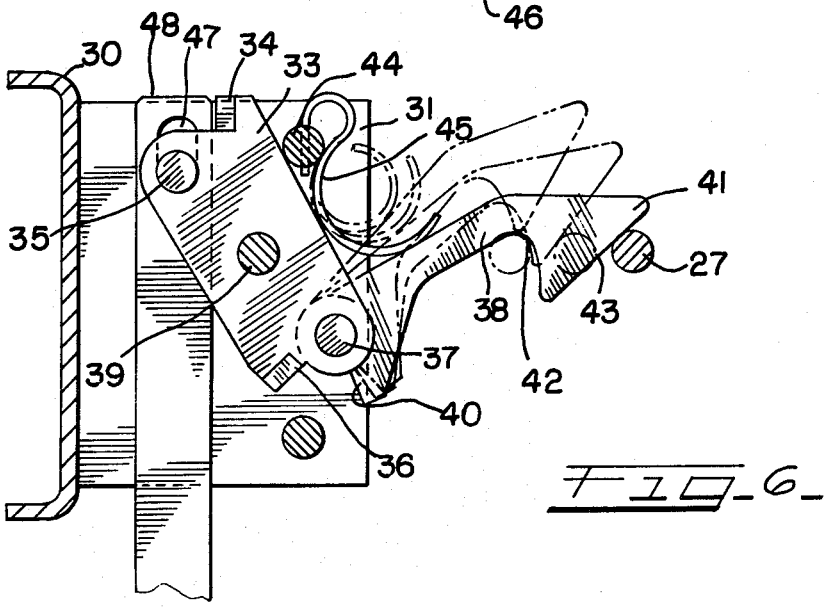
FIG. 6 is a view similar to FIG. 3 disclosing a position of a keeper prior to its engagement into locking relation relative to a latch element.

When the railway car 10 reaches its dumping pit and it is desired to release material from within the car the operator merely pulls on the link 46 whereby the lost-motion or slotted connection permits the stop end 48 of the link to be moved out of position relative to the stop 34 so that upon continued movement the cam lever 33 may now be pivoted about its pivot shaft 39. As the operator continues to pull on the link 46 the cam lever 33 is rotated and moved against the spring with the latch element 38 being forced to a substantial linear position shown in FIG. 5, with the spring continually urging the same into this position as the cam lever 33 is moved in a counterclockwise manner in said linear positions releasing the tension on the door created by the lading. This allows the cam stop 36 of the cam lever 33 to engage the cam stop 40 or the latch element 38 and thus, as indicated in the position shown in FIG. 5, the cam lever 33 and latch element 38 are in substantial linear relation. They then move in concert to lift the hook shaped projection 43 to the broken line position shown in FIG. 5 whereupon the door is free to assume its open position. As shown in FIG. 6, upon release of the link 46, the latch element 38 and the cam lever 33 now again assumes the relatively jack-knife or angular relation. The operator now wishing to close the door merely swings the door toward a closed position whereupon the keeper bar 27 now engages the inclined cam surface 43 of the hook shaped member 41 whereupon the hook shaped member is raised to the dotted line position shown in FIG. 6 until it again is disposed within the recess 42 and locked therein in the lock position as shown in FIG. 3.

Thus it is apparent that a simple and yet relatively fail-safe locking arrangement has been provided for locking the swinging doors of a bottom dump discharge car during transit. The car is securely locked and when reaching its destination can readily be opened and then again be preset for reclosing movement of the door when the same again is desired.

What is claimed is:

1. In a railway hopper car body having a discharge opening and a door structure pivotally mounted adjacent the upper part of the opening and swingable to an open position, the improvement of a latch assembly for retaining said door in a locked position comprising;

a keeper member mounted on said door, a cam lever pivotally mounted on said body, a latch element having a keeper engaging projection, means hingedly connecting one end of said cam lever to said latch element, operating means connected to the other end of said cam lever operable to pivot said cam lever and latch element between locked and open positions and including means arresting pivotal movement of said cam lever in said closed position, said cam lever and latch element in a locked position with said keeper member and said keeper engaging projection having a relative folded angular configuration and in an opening position assuming a relatively linear configuration, biasing means opposing movement of said latch to the open position and urging said cam lever and said latch element toward said linear configuration during opening movement of said latch element, and first cam stops on said cam lever and latch element engagable with each other during movement of said cam lever toward the open position imparting pivoted movement of said lever to said latch element; whereby said keeper engaging projection is disengaged from said keeper member and said door structure is swingable to an open position.

2. The invention in accordance with claim 1, said operating means comprising a link and means pivotally connecting one end of said link to said cam lever for rotating the same into said linear configuration.

3. The invention in accordance with claim 2, including a second cam stop on said cam lever, said link in a lock position engaging said second cam stop to maintain said cam lever and latch element in said angular locked configuration.

4. The invention in accordance with claim 1, said keeper engaging projection comprising a hook having a socket and an angular camming surface adapted to engage the keeper member during locking movement of said door whereby said keeper member is guided into said socket.

5. The invention in accordance with claim 1, said biasing means including a spring mounted on said body and engaging said latch element.

6. The invention in accordance with claim 1, said cam lever including releasable stop means for maintaining said lever and latch element in said angular locked position.

7. In a railway hopper car body having a discharge opening and a door structure pivotally mounted adjacent the upper part of the opening and swingable to an open position, the improvement of a latch assembly for retaining said door in a locked position comprising:

a keeper member mounted on said door, a cam lever pivotally mounted on said body, a latch element having a keeper engaging projection, means hingedly connecting one end of said cam lever to said latch element, operating means connected to the other end of said cam lever operable to pivot said cam lever and latch element between locked and open position, said cam lever and said latch element in an locked position of said keeper member and keeper engaging projection having a relative angular configuration and in an opening position assuming a relatively linear configuration, biasing means urging said cam lever and said, latch element into said linear configuration during opening movement of said latch element, first cam stops on said cam lever and latch element engaging each other during relative pivoting movement of said lever and latch element to an open position whereby said keeper engaging projection is disengaged from said keeper member and said door structure is swingable to an open position, said operating means having a link and means pivotally connecting one end of said link to said cam lever for rotating the same into said linear configuration, having a second cam stop on said cam lever, said link in a lock position engaging said second cam stop to maintain said cam lever and latch element in said angular locked configuration, and said link and means pivotally connecting said link to said cam lever including a lost-motion connection.

8. The invention in accordance with claim 7, said lost-motion connection including an elongated slot in said link and a pivot pin slideable in said slot and connected to one end of said cam lever.

9. The invention in accordance with claim 8, said link being reciprocal relative to said pivot pin which in one position is disposed at one end of said slot with said link overlying said second cam stop to prevent relative rotation of said cam lever.

10. The invention in accordance with claim 9, said link in a second position being at the other end of said slot whereby said cam lever is free to pivot from said locked position.

* * * * *